United States Patent [19]

Fritsch et al.

[11] 4,073,645

[45] Feb. 14, 1978

[54] PROCESS OF SMELTING SULPHIDIC COPPER ORE CONCENTRATES

[75] Inventors: Walter Fritsch, Bergisch-Gladbach; Gerhard Melcher, Cologne, both of Germany

[73] Assignee: Klockner-Humboldt-Deutz Aktiengesellschaft, Germany

[21] Appl. No.: 675,629

[22] Filed: Apr. 9, 1976

[30] Foreign Application Priority Data

Apr. 9, 1975 Germany ..... 2515464

[51] Int. Cl.[2] ..... C22B 15/00

[52] U.S. Cl. ..... 75/74; 75/23; 75/76; 266/173

[58] Field of Search ..... 75/74, 72, 73, 23, 26, 75/76; 266/173

[56] References Cited

U.S. PATENT DOCUMENTS

| | | | |
|---|---|---|---|
| 2,668,107 | 2/1954 | Gordon et al. | 75/74 |
| 3,351,462 | 11/1967 | Arentzen et al. | 75/74 |
| 3,674,463 | 7/1972 | Yannopoulos | 75/72 |
| 3,892,560 | 7/1975 | Nermes et al. | 75/23 |

*Primary Examiner*—Walter R. Satterfield

*Attorney, Agent, or Firm*—Hill, Gross, Simpson, Van Santen, Steadman, Chiara & Simpson

[57] ABSTRACT

A process of smelting a sulphidic copper ore concentrate comprising introducing and partially roasting the sulphidic copper ore concentrate in a whirling layer roasting furnace, separating hot roasting gases from the roasting furnace, mixing enrichment oxygen with the roasting gases, joining and mixing into a smelting flame combustible gaseous fuel and the oxygen enriched separated hot roasting gases, directing the smelting flame from one side of a reverberatory furnace over the top of a copper matte, continuously passing the partially roasted concentrate from the roasting furnace through the heating zone in the reverberatory furnace and there smelting the partially roasted ore and heating the copper matte by the heat from the flame, generating in the heating zone by virtue of the flame an oxidizing atmosphere of such high temperature and oxygen content that sulphur from the molten sulphidic copper is converted into an exhaust gas of high $SO_2$ content, and exhausting the exhaust gas from the opposite side of the reverberatory furnace from the introduction of the flame.

5 Claims, 1 Drawing Figure

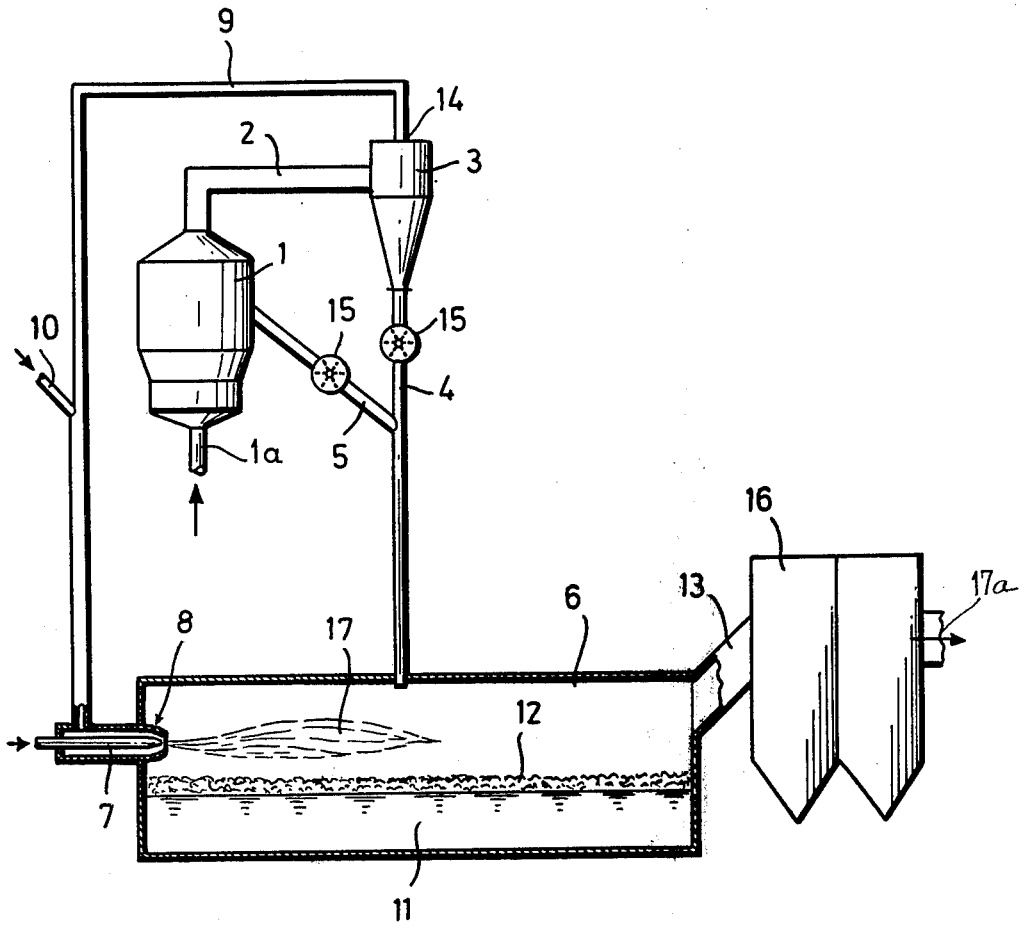
9
14
2
3
1
15
15
10
4
5
1a
16
13
17a
6
8
17
12
7
11

PROCESS OF SMELTING SULPHIDIC COPPER ORE CONCENTRATES

BACKGROUND OF THE INVENTION

The present invention relates to a new and improved process of smelting sulphidic copper ore concentrates in which the ore concentrates are first partially roasted and the smelting is completed after the separation of the hot roasting gases from the ore.

In the classic refinement of copper ore, the ore is mined and formed into an ore slurry in a mechanism such as a ball mill, and the slurry is received by a flotation cell with chemicals bringing the copper minerals to the top to be removed and dried. The concentrate is then treated in a reverberatory furnace which shoots flames above the copper ore concentrate, and as impurities rise to the top and form a slag, the slag is drained off leaving a copper matte. The copper matte is passed to a converter with the remaining blister copper being 97% or more pure. The blister copper is usually further treated, such as, for example, by being cast into anodes and electrolytically refined.

The present invention relates to an improved smelting process for removing impurities from sulphidic copper ore concentrate. The copper concentrate is generally received, as above stated, from the flotation process, and in the flotation process, the concentrate that is received is high in sulphur content. Upon the melting of the sulphidic copper ore, it is necessary to remove a part of the sulphur before smelting the copper to obtain the copper matte or metal. This is done by a roasting process in vertical furnaces or in rotary kilns, and the roasting may be accomplished in a whirling layer roasting furnace for obtaining a more accurate maintenance of optimum roasting temperature.

In the roasting process, the gas which is released is separated by means of cyclone separators and is also subjected to further cleansing or purifying, such as in electrofilters, and is conveyed to a sulphuric acid installation. By means of the partial roasting, the sulphur content of the copper ore concentrate is reduced so that the exhaust gases attained in the reverberatory furnace contain a $SO_2$ content of a maximum of 1% to 2%. This sulphur dioxide content is too low to be economically feasible to separate it from the exhaust gases. On the other hand, the sulphuric dioxide content is sufficiently high so that it exceeds the practical and the legally prescribed limits or conditions of discharge into the atmosphere and, therefore, the reverberatory furnace cannot be operated practically with sulphur dioxide discharges of these values.

For these reasons, contemporary methods have used a so called suspended melting arrangement in which the roasting and melting process is carried out simultaneously in one furnace unit, and the exhaust gases of a sulphur dioxide content sufficiently high for the economical production of sulphuric acid. It is a characteristic of this method that the selective oxidation as well as the melting step of the ore concentrate take place in suspension in a vertical shaft. In the transition of heat in the vertical column or shaft for sufficient melting of the ore, radiation and convection and conduction are used, and further the exothermic heat which is released upon the oxidation of the iron and sulphur in the concentrates is also utilized. This process, however, will result in a product substantially richer in copper than with the reverberatory process, and a copper matte product of over 60% of copper will result. However, counterbalancing the advantage of a substantially autogenous process of simultaneously roasting and melting the ore concentrate and the advantage of an exhaust gas rich in sulphur dioxide, there is a disadvantage of the copper-rich slag which results as a by-product. These slags require additional refining so that it has become necessary to provide an additional electro-furnace for the processing of the slag.

It is accordingly an object of the present invention to improve heretofore used methods and apparatuses for the refining of sulphidic copper ore concentrates so that the by-product of nonutilizable gases low in sulphur dioxide is prevented, and the entire smelting process becomes more economical and better adapted to the environment.

In accordance with the principles of the invention, the hot roasting gases are enriched with oxygen, and these enriched gases are utilized for supporting combustion in the smelting furnace instead of using secondary air.

The heat content of the smelting gas is made use of for the completion of the smelting process which leads to the appreciable reduction of fuel consumption. The incorporation of appreciable quantities of specific heat from the smelting or roasting gas results in an indirect technical utilization of the oxidation heat from the roasting process. Furthermore, the heat transition in the gas of the smelting operation in the reverberatory furnace is obtained for the greatest part through radiation. Support of combustion for heating by the roasting gas in the reverberatory furnace and with the use of oxygen, a very hot flame results which has an appreciably stronger capability of radiation heat transfer than a flame produced by means of secondary air with a supporting flow of nitrogen contained therein. Further, this results in an advantage in an increase in the smelting output of the furnace, thereby increasing the overall economy of the operation and capacity of a given smelting furnace.

In accordance with the method of the invention, utilizing the smelting gas enriched with oxygen instead of secondary air, the sum or the quantities of the exhaust gas from the roasting and smelting process is appreciably reduced because the nitrogen utilized in methods heretofore employed is eliminated. The recuperation of the heat content of the gas from the roasting and smelting material leads to a decrease in use of fuel, and this, therefore, reduces the overall quantity of gas employed for smelting a given quantity of material. Lastly, the roasting and reverberatory furnace represents one entity so that lower operation costs results. Also, because of the final exhaust gas being rich in sulphur dioxide, useful sulphuric acid recovery can be attained.

The method according to the invention utilizes a roasting smelting furnace with a cyclone separator attached on the exhaust side and a reverberatory furnace connected in series in which the hot roasted material separated off by the cyclone is melted to a copper matte, and the cyclone exhaust conduit of the cyclone is connected with the combustion air feed conduit of the burner. The roasting furnace is suitably arranged in such a manner above the reverberatory furnace such that the roasting material from the roasting chamber and from the cyclone feeds by gravity into the reverberatory furnace.

While the roasting material previously was collected into intermediary containers, it is now possible in accordance with the present method to introduce the roasting material from the cyclone separator through a charging valve directly and continuously into the furnace. The continuous charge of roasting material has reduced the quantity of exhaust gas in view of the improved economy of the process. A decrease in speed of the gas leads to a lowering of the dust loss upon charging of the roasting material.

It is accordingly an overall object of the invention to provide an improved intermediate process for the smelting and refining of copper which effects substantial economies and provides improvements over arrangements heretofore available.

Other objects, advantages and features, as well as equivalent methods and structures which are intended to be covered herein, will become more apparent with the teaching of the principles of the invention in connection with the disclosure of the preferred embodiment in the specification, claims and drawings, in which:

DRAWINGS

The single FIGURE of the drawings is a somewhat schematic sectional view illustrating an apparatus constructed and operating in accordance with the principles of the present invention.

DESCRIPTION

A whirling layer roasting furnace is illustrated at 1 receiving a supply of sulphidic copper ore concentrate from the feed inlet shown at 1*a* supplied by supply means shown schematically by the arrowed line. Suitable heating means for the furnace are provided, not shown, for simplicity of illustration. The roasting furnace may also be called a turbulent layer kiln or fluidized bed reactor. The gas with entrained solids discharged from the roasting furnace 1 passes out the top through a conduit 2 to a cyclone separator 3. In the separator, the solids or roasted material are separated from the gas and dropped downwardly through a conduit 4 to the reverberatory furnace 6. The roasted material which is discharged from the separator is augmented by the direct charge of material from the roasting furnace through conduit 5 which branches into the conduit 4.

The flow down through conduit 4 and the infeed from conduit 5 are controlled for differences in gas pressure by charging valves for each of the lines 4 and 5 as shown at 15. These charging valves prevent blow back of material up into the cyclone or into the roasting furnace due to pressure differentials, and permit the continuous flow of material downwardly into the reverberatory furnace 6. Thus, the roasting material is charged directly into the reverberatory furnace falling freely due to the force of gravity.

In the reverberatory furnace 6 a furnace temperature of approximately 1350° C is necessary for the melting operation, and a burner 8 is arranged on the front side of the furnace. This burner is supplied with liquid fuel through a conduit 7 with the fuel being preferably oil or gas. The burner 8 is constructed so that it will be supplied with the exhaust gas from the cyclone separator 3, and for this purpose the burner may have a coaxial housing so that the hot discharge roasting gases coming from the cyclone and flowing through the conduit 9 will join and mix with the burning fuel emerging as a smelting flame 17 from the burner nozzle 7.

Intermediate the ends of the roasting gas exhaust conduit 9 is a conduit 10 for feeding in a supply of oxygen and enriching the heated roasting gases. Oxygen will be supplied in such quantity as is necessary for the completion of combustion and a flame temperature of the flame 17 with sufficient intensity to obtain the aforementioned temperature within the reverberatory furnace. The heat which is contained within the oxygen enriched roasting gases 9 results in the flame 17 being of higher temperature and a higher radiation intensity than a flame supplied by secondary air and the nitrogen contained in such air. This also provides a furnace atmosphere which has a high sulphur dioxide content.

Inasmuch as the heat transition performing the melting operation in the reverberatory furnace 6 takes place to a large part through radiation, the inclusion of the oxidation heat from the iron and sulphur of the concentrate in the reverberatory furnace is no longer necessary. To the contrary, through the partial roasting of the material independently of the smelting operation, the sulphur content of the roasting material is so adjusted that a copper matte 11 with an average copper content and with a slag 12 low in copper is melted.

The otherwise unavoidable post-oxidation of the iron sulphide through the furnace atmosphere after the reaction $$FeS + 3/2\ O_2 = FeO + SO_2$$

is suppressed by virtue of the presence of a high $SO_2$ partial pressure above the charged reverberatory furnace. The sulphur dioxide rich furnace gases pass out through the final exhaust at 13, from the opposite side of the furnace 6 from the burner 8, to a waste heat boiler 16. The gases then pass into a sulphuric acid installation for recovery process, not shown in detail, but represented by the arrowed line 17*a*.

Thus, in operation, a preliminary roasting process takes place in the roasting furnace 1, and the discharge from the roasting furnace is partially fed down through the conduit 5. The gaseous portion from the roasting furnace is supplied upwardly through the conduit 2 to the cyclone separator 3, the discharge from which passes through the conduit 4 which joins the conduit 5 to effect flow of the partially roasted concentrate down into the reverberatory smelting furnace 6. The heated roasting gases flow through the conduit 9 to receive a supply of oxygen through the conduit 10 to supply the burner flame 17 in the reverberatory furnace to heat the copper matte 11 in the reverberatory furnace. The sulphur dioxide rich gases flow out through the final exhaust line 13.

What we claim as our invention is:

1. A process of smelting a sulphidic copper ore concentrate comprising the steps:

introducing and partially roasting the sulphidic copper ore concentrate in a whirling layer roasting furnace independently from a subsequent smelting operation in a reverberatory smelting furnace;

separating hot roasting gases derived from the partially roasted ore concentrate in the whirling layer roasting furnace;

mixing the separated roasting gases with enrichment oxygen;

joining and mixing into a smelting flame a combustible gaseous fuel and the oxygen enriched separated hot roasting gases;

directing the smelting flame from one side of the reverberatory smelting furnace into a heating zone over the top of a copper matte within the reverberatory smelting furnace;

continuously passing the partially roasted concentrate from the roasting furnace into and through said heating zone above said copper matte in the reverberatory smelting furnace;

in the heating zone effecting smelting of the partially roasted ore concentrate and heating of the copper matte by the heat from said flame;

generating in said heating zone by virtue of said flame an oxidizing atmosphere of such high temperature and oxygen content that sulphur from the molten sulphidic copper is converted into an exhaust gas of high $SO_2$ content;

and exhausting the exhaust gas from the opposite side of the reverberatory smelting furnace.

2. A process of smelting a sulphidic copper ore concentrate according to claim 1, comprising receiving and separating the roasting gases from the roasting furnace into a cyclone separator, conducting the separated gases from the cyclone separator to the point of joining with the gaseous fuel, and intermediate said cyclone separator and said joining with the gaseous fuel mixing the enrichment oxygen with the separated roasting gases.

3. A process of smelting a sulphidic copper ore concentrate according to claim 2, comprising joining a stream of residue of partially roasted ore from the cyclone separator with a stream of partially roasted ore from the roasting furnace, and conducting the joined streams to the reverberatory furnace.

4. A process of smelting a sulphidic copper ore concentrate, according to claim 1, comprising continuously controllably discharging the partially roasted ore from the roasting furnace gravitationally into the heating zone in the reverberatory furnace.

5. A process of smelting a sulphidic copper ore concentrate according to claim 1, including the steps of withdrawing the exhaust gases containing sulphur dioxide from the opposite end of the reverberatory furnace for processing the exhaust gases to obtain sulphuric acid.

* * * * *